US010519855B2

(12) United States Patent
Pegg et al.

(10) Patent No.: US 10,519,855 B2
(45) Date of Patent: Dec. 31, 2019

(54) ENGINE ASSEMBLY WITH INSULATED CRANKSHAFT BEARING HOUSING

(71) Applicant: Ford Global Technologies, LLC, Dearborn, MI (US)

(72) Inventors: Ian Graham Pegg, Chelmsford (GB); Roland Paul Stark, Hitchin (GB)

(73) Assignee: Ford Global Technologies, LLC, Dearborn, MI (US)

( * ) Notice: Subject to any disclaimer, the term of this patent is extended or adjusted under 35 U.S.C. 154(b) by 157 days.

(21) Appl. No.: 15/702,642

(22) Filed: Sep. 12, 2017

(65) Prior Publication Data

US 2018/0094578 A1 Apr. 5, 2018

(30) Foreign Application Priority Data

Oct. 3, 2016 (GB) ..... 1616768.6

(51) Int. Cl.

| | |
|---|---|
| ***F02B 77/11*** | (2006.01) |
| ***F02F 7/00*** | (2006.01) |
| *B05D 1/00* | (2006.01) |
| *B05D 1/18* | (2006.01) |

(52) U.S. Cl.

CPC ..... *F02B 77/11* (2013.01); *F02F 7/0053* (2013.01); *B05D 1/007* (2013.01); *B05D 1/18* (2013.01)

(58) Field of Classification Search

CPC ..... F02B 77/11; F02F 7/0053; B05D 1/007; F05D 1/18; F16C 17/22; F16C 17/243; F16C 19/525

USPC ..... 123/195 R

See application file for complete search history.

(56) References Cited

U.S. PATENT DOCUMENTS

| | | | | |
|---|---|---|---|---|
| 1,788,605 | A | 1/1931 | Walters | |
| 2,350,559 | A | 6/1944 | Kienitz | |
| 4,434,756 | A | 3/1984 | Nilsson et al. | |
| 4,511,837 | A * | 4/1985 | Vermeiren | F16C 19/52 324/671 |

(Continued)

FOREIGN PATENT DOCUMENTS

| | | | |
|---|---|---|---|
| DE | 102006039380 | A1 | 3/2008 |
| EP | 3124555 | A1 | 2/2017 |

(Continued)

OTHER PUBLICATIONS

Intellectual Property Office of the United Kingdom, Combined Search and Examination Report Issued in Application No. GB1616768.6, dated Mar. 21, 2017, 6 pages.

*Primary Examiner* — Lindsay M Low
*Assistant Examiner* — Yi-Kai Wang
(74) *Attorney, Agent, or Firm* — Geoffrey Brumbaugh; McCoy Russell LLP

(57) ABSTRACT

An engine assembly for a motor vehicle is provided. The assembly comprises a bearing housing portion configured to support a bearing for a crankshaft of the engine assembly, wherein the bearing housing portion comprises a bearing interface surface configured to interface with the bearing and an end face adjacent to the bearing interface surface, the end face being arranged so as to face a web of the crankshaft when installed. The engine assembly further comprises an insulation layer provided on the end face, the insulation layer being positioned such that the insulation layer is between the bearing housing portion and the web of the crankshaft when the crankshaft is installed in the engine assembly.

20 Claims, 4 Drawing Sheets

(56) References Cited

U.S. PATENT DOCUMENTS

| | | | | |
|---|---|---|---|---|
| 5,609,422 | A | 3/1997 | Mueller et al. | |
| 6,308,680 | B1 * | 10/2001 | Prior | F02F 7/0012 123/195 H |
| 6,647,945 | B2 * | 11/2003 | Harima | F02B 75/243 123/195 R |
| 2013/0343683 | A1 * | 12/2013 | Sanda | F01M 5/02 384/397 |
| 2014/0305399 | A1 * | 10/2014 | Pegg | F02F 7/0053 123/193.5 |
| 2016/0123225 | A1 * | 5/2016 | Paik | C08G 18/42 123/198 E |

FOREIGN PATENT DOCUMENTS

| | | | |
|---|---|---|---|
| GB | 2437089 | A | 10/2007 |
| GB | 2512893 | A | 10/2014 |
| JP | S59136521 | A | 8/1984 |
| JP | 2009209795 | A | 9/2009 |
| WO | 2014195153 | A1 | 12/2014 |

* cited by examiner

ENGINE ASSEMBLY WITH INSULATED CRANKSHAFT BEARING HOUSING

CROSS REFERENCE TO RELATED APPLICATION

The present application claims priority to Great Britain Patent Application No. 1616768.6, filed Oct. 3, 2016. The entire contents of the above-referenced application are hereby incorporated by reference in its entirety for all purposes.

TECHNICAL FIELD

The present disclosure relates to an engine assembly for a motor vehicle and is particularly, although not exclusively, concerned with an engine assembly configured to improve engine warm up.

BACKGROUND

Oil is provided within an internal combustion engine to lubricate the movement of components of the engine. Additionally, the oil may be provided to cool components of the engine, such as pistons, when the engine is operating at high heat outputs.

The viscosity of the oil varies depending on its temperature. When the oil is cold, the viscosity of the oil may be high and the power required to pump oil around the engine may also be high. Additionally, when the oil is cold and viscous, the oil may not lubricate the components of the engine assembly as effectively and friction between the components may be increased. Furthermore, due to the viscosity of the oil, the movement of the components may generate increased shear forces within the oil, which may act against the movement of the components. It may therefore be desirable for the oil to be maintained at a temperature at which the oil has a suitable viscosity.

Before the engine is started, the engine and the oil are often cold. During warmup of the engine, components of the engine may be heated due to the operation of the engine more than other components, for example, a piston of the engine may be heated and may reach an operating temperature faster than a housing of the engine, such as a cylinder block. Coming into contact with the hot engine components may increase the temperature of the oil. However, the housing of the engine may act as a heat sink. When the oil contacts the housing, heat may be transferred into the housing, which may slow the warm-up of the oil, increasing the length of time required for the oil to reach a desired temperature and viscosity.

SUMMARY

According to an aspect of the present disclosure, there is provided an engine assembly for a motor vehicle, the assembly comprising a bearing housing portion configured to support a bearing for a crankshaft of the engine assembly, wherein the bearing housing portion comprises a bearing interface surface configured to interface with the bearing and an end face adjacent to the bearing interface surface, the end face being arranged so as to face a web of the crankshaft when installed; wherein the engine assembly further comprises an insulation layer provided on the end face, the insulation layer being positioned such that the insulation layer is between the bearing housing portion and the web of the crankshaft when the crankshaft is installed in the engine assembly.

The thickness of the insulation layer may increase with a distance from a central axis of the crankshaft.

The engine assembly may further comprise the crankshaft. The thickness of the insulation layer may be configured such that a profile of the insulation layer, e.g. a cross-sectional profile in a plane parallel to the central axis of the crankshaft, matches a profile of the web.

The bearing housing portion may be part of a housing of the engine assembly, such as a cylinder block or sump block of the engine assembly. For example, the bearing housing portions may be provided on a bearing bridge, which may be formed on a cylinder block.

The assembly may further comprise a bearing cap. The bearing cap may be configured to couple to the housing. The bearing cap may comprise a further bearing housing portion. The bearing housing portion and the further bearing housing portion may be configured together to form a bearing housing, e.g. a complete bearing housing.

Alternatively, the bearing housing portion may be formed on a bearing cap configured to couple to a housing of the engine assembly. The housing may comprise a further bearing housing portion. The bearing housing portion and the further bearing housing portion may be configured together to form a bearing housing, e.g. a complete bearing housing.

The further bearing housing portion may comprise a further bearing interface surface, configured to interface with the bearing. The further bearing housing portion may comprise a further end face adjacent to the further bearing interface surface. The further end face may be arranged so as to face a web of the crankshaft when installed. The engine assembly may comprise a further insulation layer provided on the further end face between the further bearing housing portion and the web of the crankshaft.

The thickness of the further insulation layer may increase with distance from a central axis of the crankshaft. Additionally or alternatively, the thickness of the further insulation layer may be configured such that a profile of the insulation layer, e.g. a cross-sectional profile in a plane parallel to the central axis of the crankshaft, matches a profile of the web.

The bearing cap may be at least partially coated in the insulating material. The bearing cap may be coated, e.g. substantially and/or completely coated, in the insulating material. The insulating material may comprise a non-cellular polymer, such as nylon.

The bearing cap may comprise one or more interface surfaces configured to interface with the engine housing. The insulation layer may not be provided on the interface surfaces.

The end face and/or the further end face may comprise a thrust face configured to interface with a thrust washer of the bearing. The insulation layer provided on the end face and/or the further end face may be offset, e.g. radially offset, from the thrust face.

The insulation layer may comprise a foam sheet, e.g. a polymer foam sheet. The foam sheet may be bonded to the end face of the bearing housing portion, e.g. using an adhesive. The foam sheet may be an open cell foam sheet. Front and/or rear faces of the foam sheet may be coated such that the foam sheet is substantially impregnable to oil. Alternatively, the foam sheet may be a closed cell foam sheet.

The insulation layer may comprise a ceramic plate. The ceramic plate may be bonded to the bearing housing portion.

According to another aspect of the present disclosure, there is provided an engine assembly for a motor vehicle, the assembly comprising: a bearing bridge configured to provide one or more first bearing housing portions; and one or more bearing caps, each bearing cap providing a second bearing housing portion configured to correspond with one of the first bearing housing portions, wherein each pair of corresponding first and second bearing housing portions are together configured to house a bearing for supporting the rotation of a crankshaft of the engine assembly; wherein the assembly further comprises an insulating material provided on one or more surfaces of the bearing bridge and/or bearing caps.

A plurality of the bearing caps may be integrally formed onto a bearing beam.

The engine assembly may further comprise one or more bearings housed by the first and second bearing housing portions. The insulating material may not be provided on surfaces of the bearing bridge and bearing caps configured to interface with the bearings.

A vehicle may comprise any of the above-mentioned engine assemblies.

According to another aspect of the present disclosure, there is provided a method of insulating an engine assembly, the assembly comprising: a bearing housing portion configured to support a bearing for a crankshaft of the engine assembly, wherein the bearing housing portion comprises a bearing interface surface, configured to interface with the bearing, and an end face adjacent to the bearing interface surface, the end face being arranged so as to face a web of the crankshaft when installed, wherein the method comprises: providing an insulation layer on the end face, such that the insulation layer is positioned between the bearing housing portion and a web of the crankshaft when the crankshaft is installed in the engine assembly.

The insulation layer may be provided by dipping the bearing housing portion into an insulating material and curing the insulating material to provide the insulation layer.

Additionally or alternatively, the insulation layer may be provided by electrostatically coating the bearing housing portion in an insulation material to provide the insulation layer.

Additionally or alternatively again, the method may comprise bonding the insulation layer to the end face.

The method may comprise: masking one or more surfaces of the bearing housing portion prior to providing the insulation layer, e.g. such that one or more interface surfaces of the bearing housing portion do not become covered by the insulation layer.

Additionally or alternatively, the method may comprise: machining one or more surfaces of the bearing housing portion after the insulation layer has been provided to remove one or more portions of the insulation layer from the bearing housing portion.

The method may further comprise machining the end face of the bearing housing portion prior to bonding the insulation layer to the end face.

To avoid unnecessary duplication of effort and repetition of text in the specification, certain features are described in relation to only one or several aspects or embodiments of the disclosure. However, it is to be understood that, where it is technically possible, features described in relation to any aspect or embodiment of the disclosure may also be used with any other aspect or embodiment of the disclosure.

BRIEF DESCRIPTION OF THE DRAWINGS

For a better understanding of the present disclosure, and to show more clearly how it may be carried into effect, reference will now be made, by way of example, to the accompanying drawings. The figures are drawn to scale, although other relative dimensions may be used, if desired.

DETAILED DESCRIPTION

Figure 1:
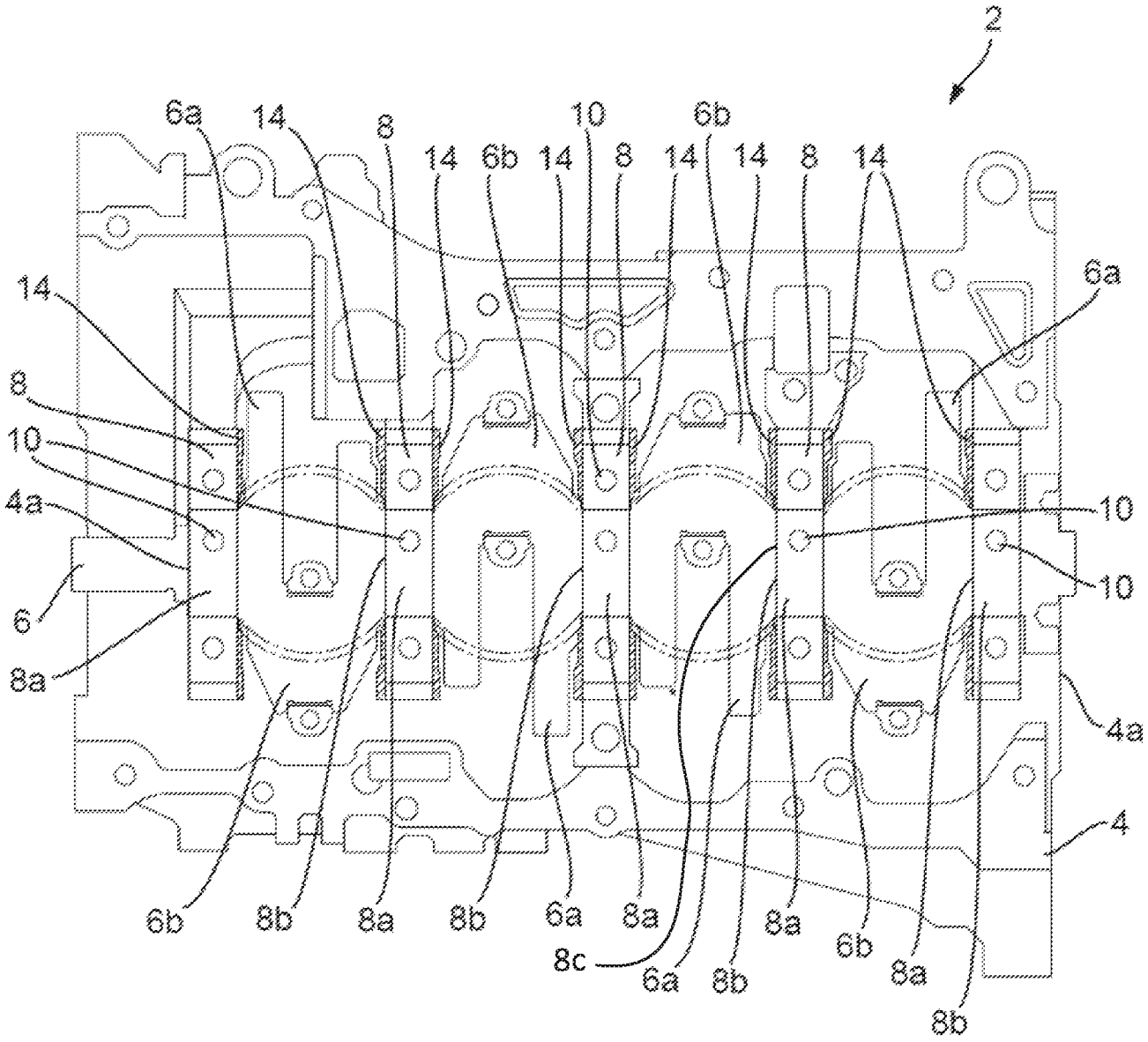
FIG. 1 is a bottom view of an engine housing, according to arrangements of the present disclosure.
Figure 2:
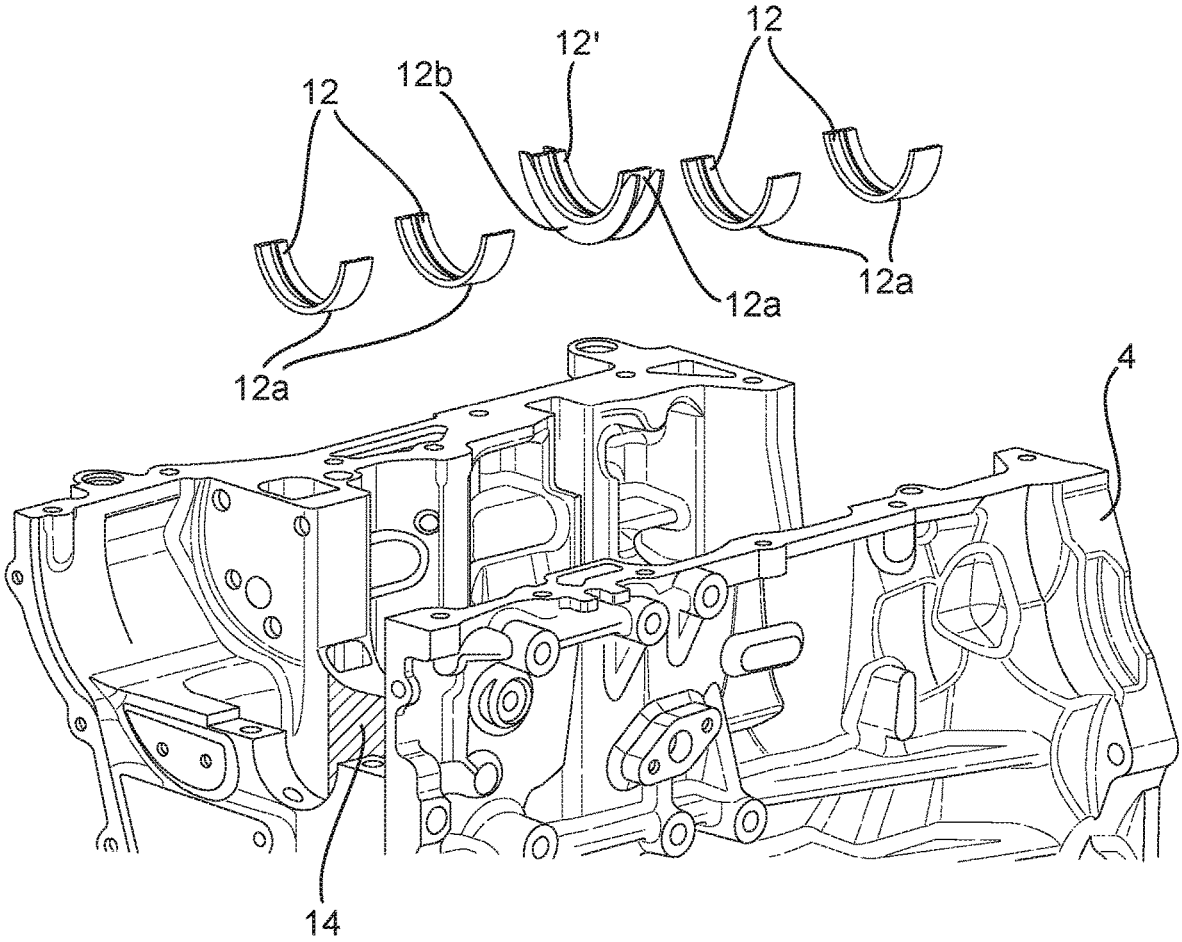
FIG. 2 is a perspective, exploded view of an underside of the engine housing and bearings, according to arrangements of the present disclosure.

With reference to FIGS. 1 and 2 an engine assembly 2, according to arrangements of the present disclosure, may comprise a housing, such as a cylinder block 4, and a crankshaft 6.

One or more bearing housing portions 8 may be provided by, e.g. formed on, the cylinder block 4. In the arrangement shown in FIG. 1, five bearing housing portions 8 are provided and configured to form a bearing bridge of the cylinder block 4. The bearing housing portions 8 may be configured to support respective bearings 12 of the engine assembly. The bearings 12 may be configured to support the crankshaft 6 and facilitate rotation of the crankshaft 6 relative to the cylinder block 4. In the arrangement shown in FIG. 2, the bearings 12 are journal bearings provided in two halves and the bearing housing portions 8 are configured to house one half of the bearing 12. In FIG. 2, only the half of the bearing to be housed in the bearing housing portion 8 is depicted. In other arrangements of the disclosure, it is also envisaged that the bearing housing portions 8 may be configured to house ball bearings, roller bearings or any other type of bearing.

The bearing housing portions 8 may comprise a bearing interface surface 8*a*. The bearing interface surface 8*a* may be configured to interface with an outer surface 12*a* of a corresponding bearing 12. As shown in FIG. 2, the outer surface 12*a* of the bearing may be substantially radial, e.g. defined by a radial distance from a central axis of the bearing. Accordingly, the bearing interface surface 8*a* is arcuate with a center of curvature coincident with the crankshaft longitudinal axis.

In the arrangement shown in FIGS. 1 and 2, the bearing interface surface 8*a* has a greater width, e.g. in an axial direction of the bearing 12, than the bearing outer surface 12*a*. However, in some arrangements, the width of the bearing interface surface 8*a* and the bearing outer surface 12*a* may be the same.

The bearing housing portions 8 may further comprise one or more end faces 8*b* provided adjacent to the bearing interface surface 8*a*. The bearing housing portions 8 may comprise two end face 8*b* provided at opposite axially spaced ends of the bearing interface surfaces 8*a*. The end faces 8*b* may extend away from the bearing interface surfaces 8*a* in a substantially radial direction relative to a central axis of the crankshaft 6. In alternative arrangements, the end faces 8*b* may extend away from the bearing interface surfaces at an angle, e.g. a non-perpendicular angle, relative to the bearing interface surface and the radial direction of the crankshaft 6.

As shown in FIG. 1, one or more of the bearing housing portions 8 may be provided adjacent to an outer wall 4*a* of the engine housing 4. The bearing housing portion 8 may be formed integrally with the outer wall and hence, the bearing housing portion 8 may not form an internal end face 8*b* on a side of the bearing housing portion forming a portion of the outer wall 4*a*.

As shown in FIGS. 1 and 2, the end faces 8*b* of the bearing housing portions 8 may be provided adjacent to webs 6*a*, 6*b* of the crankshaft 6. As depicted, the webs 6*a* may form crank throws and/or webs 6*b* may form counterweights of the crankshaft 6.

The bearing housing portions 8 may further comprise oil feeds 10 configured to allow oil from an oil system of the engine assembly 2 to be delivered to the bearings 12 to lubricate the rotation of the crankshaft 6.

Due to the movement of the crankshaft 6 within the bearings 12, and the supply of oil from the oil feeds 10, oil may leave, e.g. flow out of, the bearings during rotation of the crankshaft 6. Under some operating conditions of the engine assembly, a flow of oil may be continuously leaving each bearing 12. The oil leaving the bearings 12 may flow through the engine assembly 2 back to an oil sump (not shown) of the engine assembly, in which the oil is collected prior to being pumped around the engine. In particular, oil leaving the bearings may flow over the internal end faces 8*b* of the bearing housing portion 8 to reach the oil sump.

Figure 3:
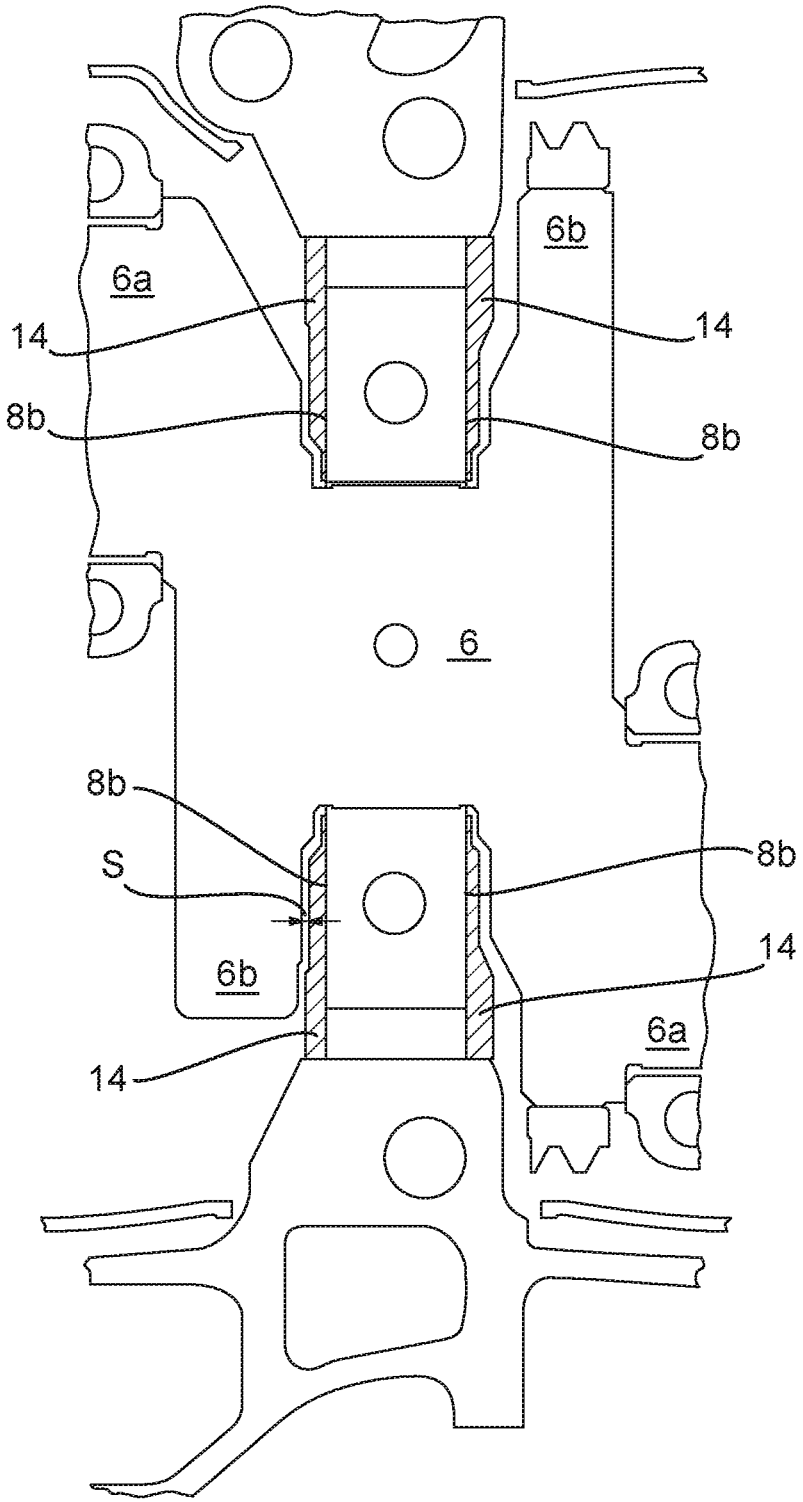
FIG. 3 is a partial sectional view through an engine assembly, according to arrangements of the present disclosure.

During warm up of the engine assembly 2, the oil leaving the bearings 12 may be at a greater temperature than the engine housing 4. As shown in FIGS. 1 and 3, a layer of insulation 14 may be provided on each of the end faces 8*b* between the end face 8*b* and the web 6*a*, 6*b* of the crankshaft 6. Oil leaving the bearings 12 may flow over the layers of insulation 14 rather than contacting the end face 8*b*. The transfer of heat from the oil to the engine housing 4 may thereby be reduced.

The thickness of the layer of insulation 14, e.g. in the longitudinal direction of the crankshaft, may vary over the end face 8*b*. In particular, the thickness of the layer of insulation 14 may increase with radial distance from the central axis of the crankshaft 6. As shown in FIG. 3, the thickness of the layer of insulation 14 may be configured such that a profile, e.g. a cross-sectional profile parallel to the longitudinal axis of the crankshaft, of the layer of insulating material corresponds to a profile of the web 6*a*, 6*b*. Configuring the thickness of the insulation material in this way may allow the greatest thickness of insulation to be applied over the end face 8*b* while maintaining a desired minimum clearance between the layer of insulation 14 and the crankshaft 6. Accordingly, a spacing S between the web and the insulation layer 14 may be maintained across a range of radial positions and the thickness of the insulation layer may be maximized.

In the arrangement depicted in FIGS. 1 to 3, the layer of insulation 14 comprises a sheet of closed cell foam. Alternatively, the layer of insulation 14 may comprise an open cell foam. The open cell foam may be configured such that oil is discouraged or prevented from permeating the cells of the foam. For example, the open cell foam may be coated in an oil impermeable material. The foam may be bonded to the end faces 8*b* of the bearing housing portion 8, e.g. using an adhesive.

The engine housing 4 may be manufactured using a casting process, and hence the end faces 8*b* may have a rough or uneven surface finish. Hence, the foam may be configured to bend or deform in order to conform to the surface of the end faces 8*b* to improve the bond between the foam and the bearing housing portion 8.

In other arrangements of the disclosure (not shown), the layer of insulation 14 may comprise a ceramic material, e.g. a ceramic plate. The ceramic material may be formed into the layer 14 and may be bonded to the end face 8*b*. The ceramic material may not be capable of bending or deforming, or otherwise conforming to the cast surface of the end face 8*b*. However, the end face 8*b* and/or the layer 14 may be configured such that bonding between the ceramic layer and the end face 8*b* is facilitated. For example, the manufacturing tolerances of the bearing housing portion 8 may be adjusted in order to increase the contact area between the ceramic layer and the end face 8*b*. In some arrangements, the bearing housing portion, e.g. the end face 8*b*, may be produced by a machining process such as a milling process. The machining process may be performed on the engine housing 4 following casting of the engine housing 4.

As mentioned above, the bearing housing portion 8 may have a greater width than the bearing outer surface 12*a*. When the end face 8*b* is produced through the machining operation, it may be desirable to machine the bearing housing portions 8, such that the bearing housing portions have the same width, e.g. in the axial direction of the bearings, as the outer surfaces 12*a*. This may allow the thickness of the layer of insulation 14 provided between the bearing housing portion 8 and the crankshaft 6 to be increased, without reducing the clearance between the layer of insulation 14 and the crankshaft webs 6*a*, 6*b*.

Figure 4:
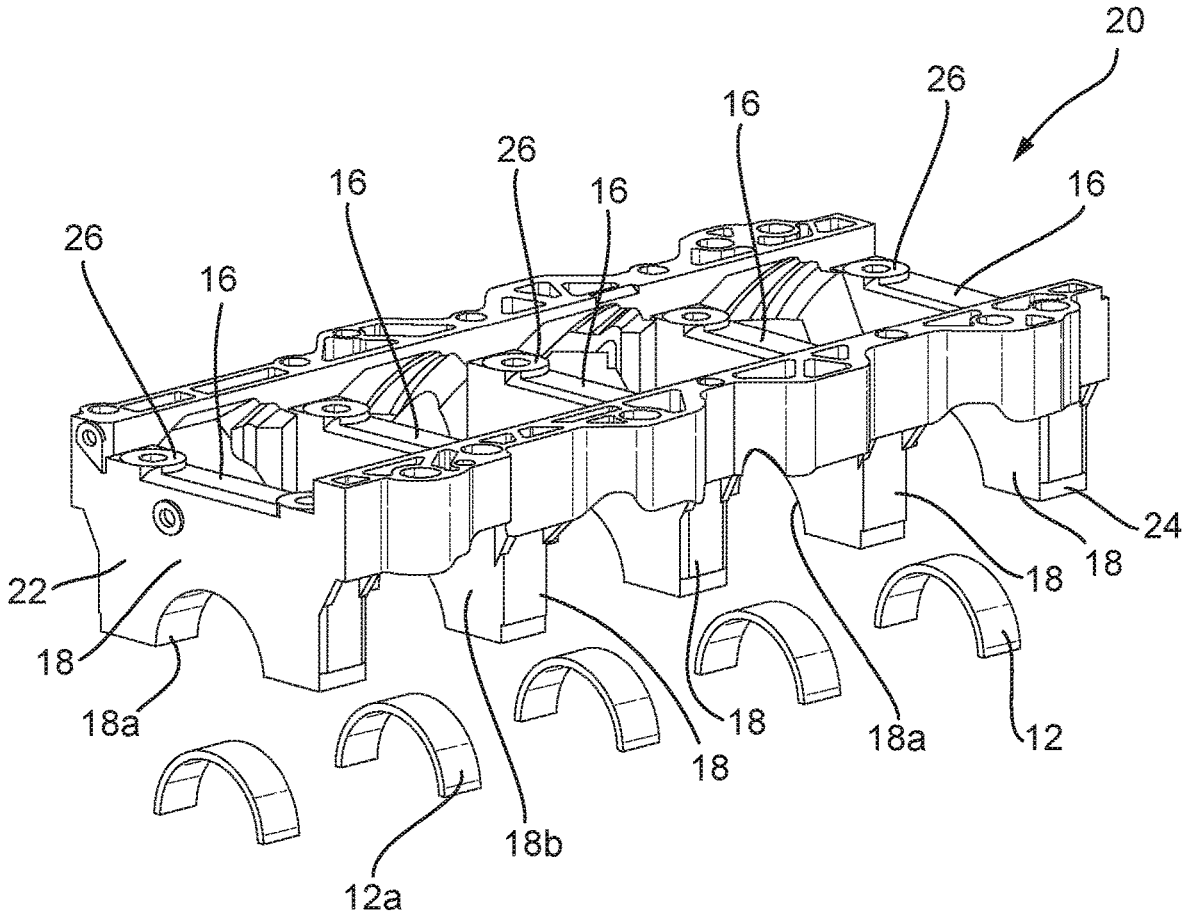
FIG. 4 is a perspective view of a bearing beam, according to arrangements of the present disclosure.

With reference to FIG. 4, the engine assembly 2 may further comprise one or more bearing caps 16. Each of the bearing caps 16 may comprise a further bearing housing portion 18. The bearing caps 16 may be configured to couple to the engine housing 4 such that corresponding ones of the bearing housing portions 8 and further bearing housing portions 18 are arranged to provide a complete bearing housing.

In the arrangement shown in FIG. 4, the bearing caps 16 are provided as an integrally formed bearing beam 20 comprising each of the further bearing housing portions 18. Any of the features described below in relation to the bearing beam 20 may equally apply to individually formed bearing caps 16.

Each of the further bearing housing portions 18 may comprise a further bearing interface surface 18*a* configured to interface with a corresponding bearing 12. As depicted in FIG. 4, each of the further bearing housing portions 18 may comprise a further end face 18*b* provided adjacent to the bearing interface surface 18*a* at each end of the bearing interface surface 18*a*, e.g. the further end faces 18*b* may be axially spaced apart on either side of the bearing interface surface 18*a*.

A further insulation layer 22 may be provided on one or more of the end faces 18*b*, between the further bearing housing portions 18 and the webs 6*a*, 6*b* of the crankshaft. The further insulation layer 22 may be similar to the insulation layer 14 described above with reference to FIGS. 1 to 3.

In the arrangement depicted in FIG. 4, the further layer of insulation 22 has been provided on each of the end faces 18*b* by coating the bearing beam 20 in an insulating material. For example, the bearing beam 20 may be dipped in the insulating material and the insulating material may be cured to form the further layer 22. Alternatively, the bearing beam may be electrostatically coated with the insulating material. The insulating material may be a polymer material, e.g. a non-cellular polymer material, such as nylon. As shown in FIG. 4, when the further layer of insulation 22 is provided on the end faces 18*b*, the bearing beam 20, e.g. each of the bearing caps 16, may be substantially completely coated in the insulation material.

Similarly to the insulation layer 14 provided on the bearing housing portions, the thickness of the further insulation layer 22 may vary over the further end face 18*b*. For example, the thickness of the further insulation layer 22 may increase with distance from the central axis of the crankshaft 6. The thickness of the further insulation layer 22 may be configured such that a profile, e.g. a cross-sectional profile parallel to the longitudinal axis of the crankshaft, of the further insulating layer 22 matches the profile of the web 6*a*, 6*b* of the crankshaft. As described above, this may allow the greatest thickness of insulation 22 to be applied over the further end face 18*b* whilst maintaining a desired minimum clearance between the layer of insulation 22 and the crankshaft 6.

As mentioned above, the further bearing interface surfaces 18*a* may be configured to interface with the outer surface 12*a* of the bearings. Hence, it may not be desirable to provide the layer of insulation 22 on the further bearing interface surfaces 18*a*. To prevent the insulation being provided on the further bearing interface surfaces 18*a*, the further bearing interface surfaces may be masked prior to applying the insulating material. Alternatively, the layer 22 may be removed from the further bearing interface surfaces 18*a* after the bearing beam 20 has been coated. For example, using a machining process, such as a milling process.

The bearing beam 20 may further comprise one or more interface surfaces 24, configured to interface with the engine housing 4 when the bearing beam 20 is coupled to the engine housing 4. The interface surfaces 24 may be configured such that when the bearing beam 20 is coupled to the engine housing 4, the bearing housing portions 8 and further bearing housing portions 18 are suitably aligned in order to provide the bearing housings. It may be desirable not to provide the further insulating layer 22 on the interface surfaces 24 and hence, the interface surfaces 24 may be masked in the same way as the further bearing interface surfaces 18*a* prior to providing the further layer of insulation 22. Alternatively, the interface surfaces 24 may be machined after the bearing beam 20 has been coated in the insulating material.

Additionally or alternatively, the bearing beam 20 may comprise one or more fastener seats 26, against which the heads of one or more fasteners may be seated when the bearing beam 20 is coupled to the engine housing 4 using the fasteners. It may not be desirable to provide the further insulating layer 22 on the fastener seats 26 and hence, the fastener seats may be masked or machined in the same way as the interface surfaces 24.

With reference to FIG. 2, one or more of the bearings 12 may be thrust bearings 12' configured to provide a reaction force at a thrust face the crankshaft 6 in order to balance axial loads on the crankshaft 6. As depicted in FIG. 2, the thrust bearing 12' may comprise a thrust washer 12*b*, which may extend radially from the thrust bearing 12'. The thrust washer 12*b* may interface with the end face 8*b* of the bearing housing portion 8 at a thrust face 8*c* on which the thrust bearing is housed.

The thrust washer 12*b* may be configured to transfer axial loads from the crankshaft 6 into the engine housing 4 through the bearing housing portion 8. Hence, it may not be desirable to provide the layer 14 of insulation in the area of the end face 8*b* configured to interface with the thrust washer 12*b*. The insulation layer 14 may therefore be offset from the thrust bearing 12', e.g. radially offset relative to the central axis of the thrust bearing 12, in the area of the thrust washer 12*b*.

In the arrangement shown in FIGS. 2 and 4, the thrust washer 12*b* is a half washer and is provided on the half of the bearing 12 that is housed by the bearing housing portion 8 formed on the engine housing 4. However, in other arrangements, the thrust washer 12*b* may be a full washer, e.g. the thrust washer may be provided on both halves of the bearing 12. In this arrangement, the further layer of insulation 22 provided on the bearing caps 16 may be offset from the further bearing interface surface 18*a*, such that an area of the further end face 18*b* adjacent to the thrush washer 12*b* is not provided with the insulating layer 22.

In the arrangement depicted in FIGS. 1 to 4, the bearing housing portions 8 are configured to house an upper half of the bearing 12 and are formed onto the cylinder block 4 of the engine assembly 2, and the bearing caps 16 configured to house lower halves of the bearings 12 are coupled to the cylinder block 4. However, it is also envisaged that the bearing housing portions 8 may be configured to house the lower halves of the bearings 12 and may be formed onto a sump block of the engine assembly. Accordingly, the bearing caps 16 may be configured to house upper halves of the bearings 12 and may be coupled to the sump block.

FIGS. 1-4 show example configurations with relative positioning of the various components. If shown directly contacting each other, or directly coupled, then such elements may be referred to as directly contacting or directly coupled, respectively, at least in one example. Elements described as directly downstream or directly upstream of one another may be defined herein such that there are no intervening components between the two comparative elements. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated by those skilled in the art that although the disclosure has been described by way of example, with reference to one or more exemplary examples, it is not limited to the disclosed examples and that alternative examples could be constructed without departing from the scope of the disclosure as defined by the appended claims.

The invention claimed is:

1. An engine assembly for a motor vehicle, the assembly comprising a bearing housing portion configured to support a bearing for a crankshaft of the engine assembly, wherein the bearing housing portion comprises a bearing interface surface configured to interface with the bearing and an end face adjacent to the bearing interface surface, the end face being arranged so as to face a web of the crankshaft when installed;

wherein the engine assembly further comprises a thermal insulation layer provided on the end face, the thermal insulation layer being positioned between the end face of the bearing housing portion and the web of the crankshaft when the crankshaft is installed in the engine assembly.

2. The engine assembly of claim 1, wherein a thickness of the thermal insulation layer increases with a distance from a central axis of the crankshaft.

3. The engine assembly of claim 2, wherein the engine assembly further comprises the crankshaft; and wherein the thickness of the thermal insulation layer is configured such that a profile of the thermal insulation layer matches a profile of the web.

4. The engine assembly of claim 1, wherein the assembly further comprises a bearing cap, the bearing cap configured to couple to the bearing housing portion, the bearing cap comprising a further bearing housing portion comprising an end face covered by thermal insulation positioned between the further bearing housing portion and the web of the crankshaft.

5. The engine assembly of claim 4, wherein the further bearing housing portion comprises a further bearing interface surface, configured to interface with the bearing, and a further end face adjacent to the further bearing interface surface; and wherein the engine assembly comprises a further thermal insulation layer provided on the further end face between the further bearing housing portion and the web of the crankshaft.

6. The engine assembly of claim 5, wherein a thickness of the further thermal insulation layer increases with a distance from a central axis of the crankshaft.

7. The engine assembly of claim 5, wherein a thickness of the further thermal insulation layer is configured such that a profile of the further thermal insulation layer matches a profile of the web.

8. The engine assembly according to claim 4, wherein the bearing cap comprises one or more interface surfaces configured to interface with the engine housing, wherein the thermal insulation layer is not provided on the interface surfaces.

9. The engine assembly according to claim 4, wherein the thermal insulating material comprises a non-cellular polymer.

10. The engine assembly according to claim 1, wherein the end face comprises a thrust face configured to interface with a thrust washer of the bearing; wherein the thermal insulation layer provided on the end face is offset from the thrust face.

11. The engine assembly according to claim 1, wherein the thermal insulation layer comprises a foam sheet, wherein the foam sheet is bonded to the end face of the bearing housing portion.

12. The engine assembly according to claim 1, wherein the thermal insulation layer comprises a ceramic plate, wherein the ceramic plate is bonded to the bearing housing portion.

13. A method of insulating an engine assembly, the assembly comprising:

a bearing housing portion configured to support a bearing for a crankshaft of the engine assembly, wherein the bearing housing portion comprises a bearing interface surface, configured to interface with the bearing, and an end face adjacent to the bearing interface surface, the end face being arranged so as to face a web of the crankshaft when installed, wherein the method comprises:

providing a thermal insulation layer on the end face, such that the thermal insulation layer is positioned between the end face of the bearing housing portion and the web of the crankshaft when the crankshaft is installed in the engine assembly.

14. The method of claim 13, wherein the thermal insulation layer is provided by:

dipping the bearing housing portion into an insulating material; and curing the insulating material to provide the thermal insulation layer.

15. The method of claim 13, wherein the thermal insulation layer is provided by:

electrostatically coating the bearing housing portion in a thermal insulation material to provide the thermal insulation layer, and masking one or more surfaces of the bearing housing portion prior to providing the thermal insulation layer.

16. The method of claim 13, wherein the method comprises:

machining one or more surfaces of the bearing housing portion after the thermal insulation layer has been provided to remove one or more portions of the thermal insulation layer from the bearing housing portion.

17. The method of claim 13, wherein the method comprises bonding the thermal insulation layer to the end face, and further comprising machining the end face of the bearing housing portion prior to bonding the thermal insulation layer to the end face.

18. An engine assembly for a motor vehicle, the assembly comprising:

a bearing housing contacting a bearing for a crankshaft along a bearing interface surface, an end face of the bearing housing extending away from bearing interface surface in a radial direction of the crankshaft and positioned to face a web of the crankshaft; and a thermal insulation layer on the end face positioned between the end face and the web of the crankshaft.

19. The engine assembly for the motor vehicle of claim 18, wherein a thickness of the thermal insulation layer increases as it extends in the radial direction of the crankshaft.

20. The engine assembly for the motor vehicle of claim 19, wherein a cross-sectional profile of the thermal insulation layer matches a cross-sectional profile of the web of the crankshaft.

* * * * *